US008387710B2

(12) United States Patent
George et al.

(10) Patent No.: US 8,387,710 B2
(45) Date of Patent: Mar. 5, 2013

(54) DOWNHOLE FLUID RECIRCULATION VALVE AND METHOD FOR RECIRCULATING FLUID IN A WELL

(75) Inventors: Grant George, Calgary (CA); Geoff Steele, Calgary (CA); Jordan James, Edmonton (CA)

(73) Assignee: Stellarton Technologies Inc., Calgary, Alberta (CA)

( * ) Notice: Subject to any disclaimer, the term of this patent is extended or adjusted under 35 U.S.C. 154(b) by 0 days.

(21) Appl. No.: 12/398,651

(22) Filed: Mar. 5, 2009

(65) Prior Publication Data

US 2009/0242210 A1 Oct. 1, 2009

(30) Foreign Application Priority Data

Mar. 5, 2008 (CA) ..... 2623902

(51) Int. Cl.
*E21B 33/10* (2006.01)
*E21B 34/06* (2006.01)
*G05D 11/00* (2006.01)

(52) U.S. Cl. ..... 166/386; 166/321; 137/87.06; 137/114

(58) Field of Classification Search ..... 166/374, 166/372, 386, 131, 184, 321, 312; 137/87.06, 137/114
See application file for complete search history.

(56) References Cited

U.S. PATENT DOCUMENTS

| | | | | | |
|---|---|---|---|---|---|
| 2,064,272 | A * | 12/1936 | Scott | 417/58 |
| 3,193,016 | A * | 7/1965 | Knox | 166/184 |
| 3,583,481 | A * | 6/1971 | Vernotzy | 166/184 |
| 3,653,439 | A * | 4/1972 | Kisling, III | 166/317 |
| 4,258,793 | A * | 3/1981 | McGraw et al. | 166/374 |
| 4,291,723 | A * | 9/1981 | Beimgraben et al. | 137/508 |
| 4,354,554 | A * | 10/1982 | Calhoun et al. | 166/321 |
| RE31,842 | E * | 3/1985 | Weitz | 166/312 |
| 4,832,126 | A * | 5/1989 | Roche | 166/358 |
| 2002/0017384 | A1 * | 2/2002 | Ostocke et al. | 166/85.1 |
| 2004/0084190 | A1 * | 5/2004 | Hill et al. | 166/386 |
| 2006/0011354 | A1 * | 1/2006 | Logiudice et al. | 166/380 |
| 2008/0164035 | A1 * | 7/2008 | Bolding et al. | 166/373 |

* cited by examiner

*Primary Examiner* — Shane Bomar
*Assistant Examiner* — Catherine Loikith
(74) *Attorney, Agent, or Firm* — Bennett Jones LLP

(57) ABSTRACT

A downhole valve for insertion in a production tubing string permits recirculation of fluid pumped into the casing annulus. The valve includes a cylindrical housing defining an opening, an internal mandrel disposed within the housing, defining a central bore and defining an opening, a valve between the housing and the mandrel, wherein said valve opens to allow fluid communication from the mandrel central bore to the annulus space in response to a pressure differential between the mandrel central bore and the annular space, and biasing means for biasing the valve in a closed position. The valve may be set within a completion string by wireline techniques.

8 Claims, 6 Drawing Sheets

DOWNHOLE FLUID RECIRCULATION VALVE AND METHOD FOR RECIRCULATING FLUID IN A WELL

FIELD OF INVENTION

The present invention relates to a fluid recirculation valve, and more particularly to a downhole gas recirculation valve used in well completions.

BACKGROUND

A well completion refers to the process of making an oil or gas well ready for production. Generally, this process involves running in production tubing, and perforating or stimulating as required.

Some gas producing wells use plungers to lift production gas and liquids to the surface by providing a seal within the production tubing and utilizing downhole pressure to lift the plunger. In some cases, a plunger lift may be enhanced by increasing downhole pressure. In a relatively non-porous formation, gas or fluid may be injected into the casing-tubing annulus, which in turn returns up through the production tubing. However, in such techniques cannot be used in more porous formations as the fluid will be lost into the formation.

It is known to provide means for recirculating fluid from the annular space through to the production tubing, however such means have invariably involved a check valve which forms part of the tubing string. The disadvantage to this completion is the check valve is permanent and cannot be serviced. Once the useful lift of this valve is reached it must be disabled with the use of a tubing patch or an expensive well re-completion.

Therefore, there is a need in the art for an improved downhole valve which permits one way flow of fluids from the annular space to the tubing string while mitigating the disadvantages of the prior art.

SUMMARY OF INVENTION

The present invention relates to a gas recirculation valve which may be installed during a well completion and which is installed through the production tubing. As a result, installation, removal and servicing may be accomplished without expensive re-completions. This valve also provides a means for retrieval and servicing via wireline intervention.

In one aspect, the invention may comprise a downhole valve for insertion in a production tubing string and a casing string, wherein an annular space is defined between the tubing and the casing, said valve comprising:

(a) a cylindrical housing defining an opening;

(b) an internal mandrel disposed within the housing, defining a central bore and defining an opening;

(c) a valve disposed between the housing and the mandrel, wherein said valve is moveable between an open position which allows fluid communication from the mandrel central bore to the annular space through the housing opening and the mandrel opening, wherein said valve is responsive to a pressure differential between the mandrel central bore and the annular space; and (d) a spring for biasing the valve in a closed position.

In another aspect, the invention may comprise a method of recirculating fluid in a well comprising a production tubing string and a casing string, wherein an annular space is defined between the tubing and the casing, said method comprising the steps of:

(a) installing a downhole fluid recirculation valve into a completion string which forms part of the production tubing string, wherein said valve is disposed between two packoffs isolating a valve zone between them, said valve zone is in fluid communication with the annular space;

(b) installing isolation means for isolating the annular space below the isolation means from the annular space above the isolation means; and (c) pumping fluid under pressure into the annular space such that the valve opens and the fluid passes into the production tubing string and returns to the surface.

The recirculating gas may be used to drive an intermitting plunger in the production tubing string or it may be used to maintain a critical or minimum gas flow rate in the tubing.

In another aspect, the invention comprises a method of setting a downhole fluid recirculation valve within a completion string, comprising the steps of placing a completion string comprising a tubing sliding sleeve within a wellbore, setting an upper packoff and a lower packoff to define a valve zone, running the valve within the completion string to a position within the valve zone by a wireline.

BRIEF DESCRIPTION OF THE DRAWINGS

Exemplary embodiments are illustrated in referenced figures of the drawings. It is intended that the embodiments and figures disclosed herein are to be considered illustrative rather than restrictive.

DETAILED DESCRIPTION

The present invention relates to a method and apparatus for recirculating fluids in a wellbore having an annular space between a casing string and a tubing string. When describing the present invention, all terms not defined herein have their common art-recognized meanings. To the extent that the following description is of a specific embodiment or a particular use of the invention, it is intended to be illustrative only, and not limiting of the claimed invention. The following description is intended to cover all alternatives, modifications and equivalents that are included in the spirit and scope of the invention, as defined in the appended claims.

Figure 1:
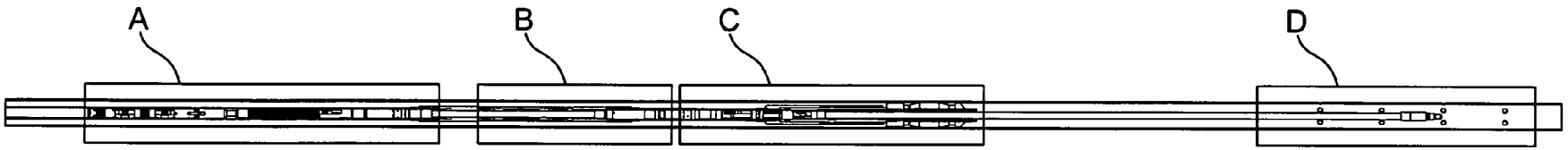
FIG. 1 is a schematic disclosing the different sections of a well-bore.

In one embodiment, the valve (10) described herein is a completion tool which is part of a completion string, as shown in FIG. 1. The following description is of one embodiment of the tool and its use in a gas re-circulation completion.

Figure 2:
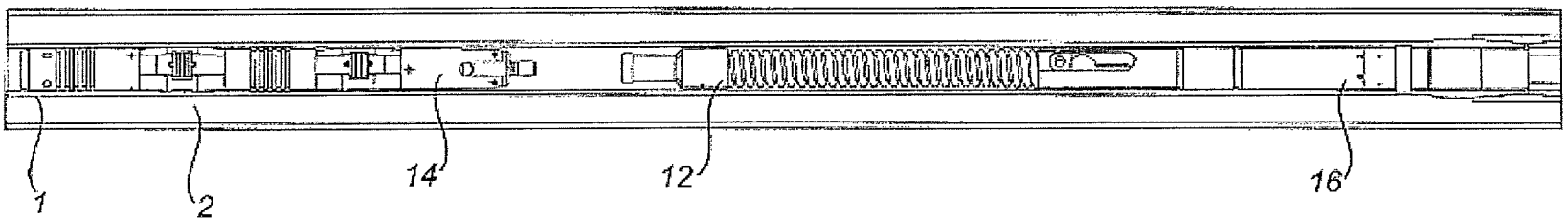
FIG. 2 is a schematic of the upper section of a well-bore disclosed in FIG. 1.

As shown in FIGS. 1 and 2, the valve (10) is installed as part of a completion string which includes an upper section (A) having a landing spring (12) for an intermitter (14), such as an intermitter described in Applicant's co-owned U.S. Pat. No. 7,188,670. As is well known in the art, the intermitter (14) travels up and down within the production tubing (1), pushing up accumulated well fluids to the surface. It is urged upward by pressure within the production tubing, below the intermitter (14).

The various components of the completion string are well known in the art, and are not intended to be limiting of the valve of the present invention, unless specifically claimed in that manner.

The valve (10) is run into the flow control section (B) between two wireline conveyed tubing packoffs (16, 18). The upper velocity tube packoff (16) may be located in upper section (A). The lower section (C) includes the lower velocity tube packoff (18) and the velocity tube anchor (20). The upper and lower packoffs (16, 18) isolate the valve zone within the production tubing. The lower velocity tube (22) hangs from the velocity tube anchor (20) and ends with a velocity tube isolation valve (28) in the perforation section (D). The lower velocity tube (22) passes through the tubing packoff (26) which isolates the annular space from the perforation section (D).

The production tubing (1) is in selective fluid communication with the annular space by means of perforations or a sliding sleeve (19) which can be opened or closed. The perforations or sliding sleeve open up the tubing in the valve zone between the upper and lower packoffs (16, 18). The valve (10) resides in the valve zone, and may be is run in inside the sliding sleeve (19) on an upper velocity tube (23).

Thus fluid communication between the annulus and the production tubing, above the tubing packoff (26) is controlled by the sliding sleeve (19) and the valve (10).

Figure 3:
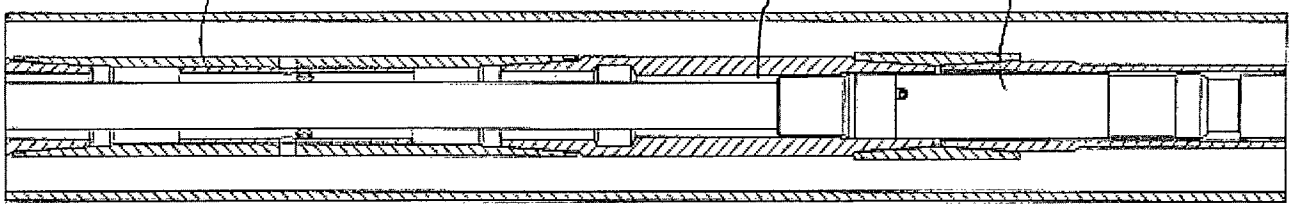
FIG. 3 is a schematic of the flow control section of a well-bore disclosed in FIG. 1.
Figure 4:
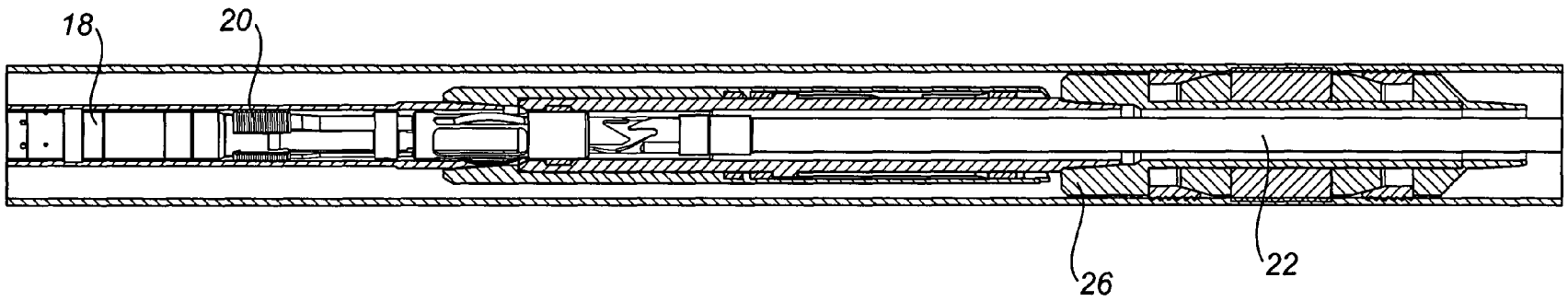
FIG. 4 is a schematic of the lower section of the well-bore disclosed in FIG. 1.
Figure 5:
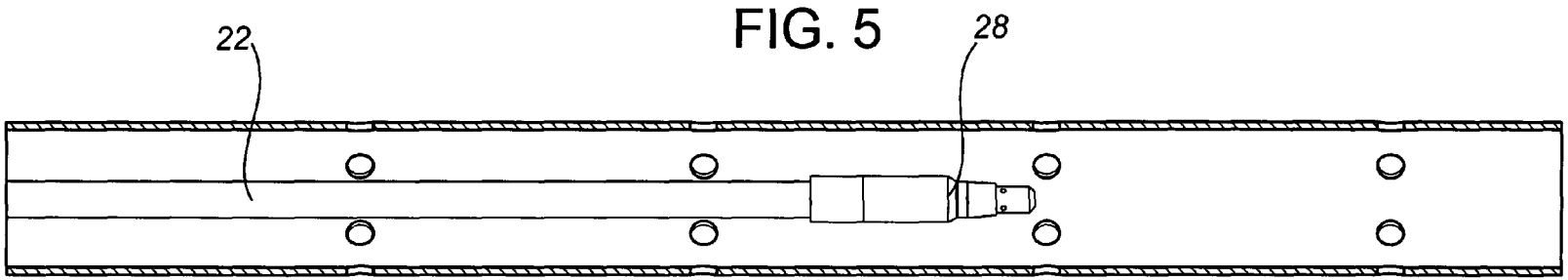
FIG. 5 is a schematic of the well-bore perforation section disclosed in FIG. 1.

In one embodiment, the valve (10) may be installed above the sliding sleeve (19) rather than the configuration shown in FIG. 3, where the valve (10) is disposed below the sliding sleeve (19).

Produced fluids from the perforation section enters the tubing (1) through the isolation valve (28) into the lower velocity tube (22), passes through the valve (10), and upwards through the upper velocity tube (23) and into the production tubing.

The valve (10) permits one-way flow of fluids from the annular space between the tubing (1) and the casing (2), above the tubing packoff (26), into the tubing. Gas or liquid introduced into the annular space is isolated from the perforation section (D) by the tubing packoff (26). As a result, such gas or liquid will return to the surface by entering the tubing through the valve (10). Thus, the tubing below the intermitter may be pressurized by injecting fluids into the annular space and through the valve (10).

Figure 6:
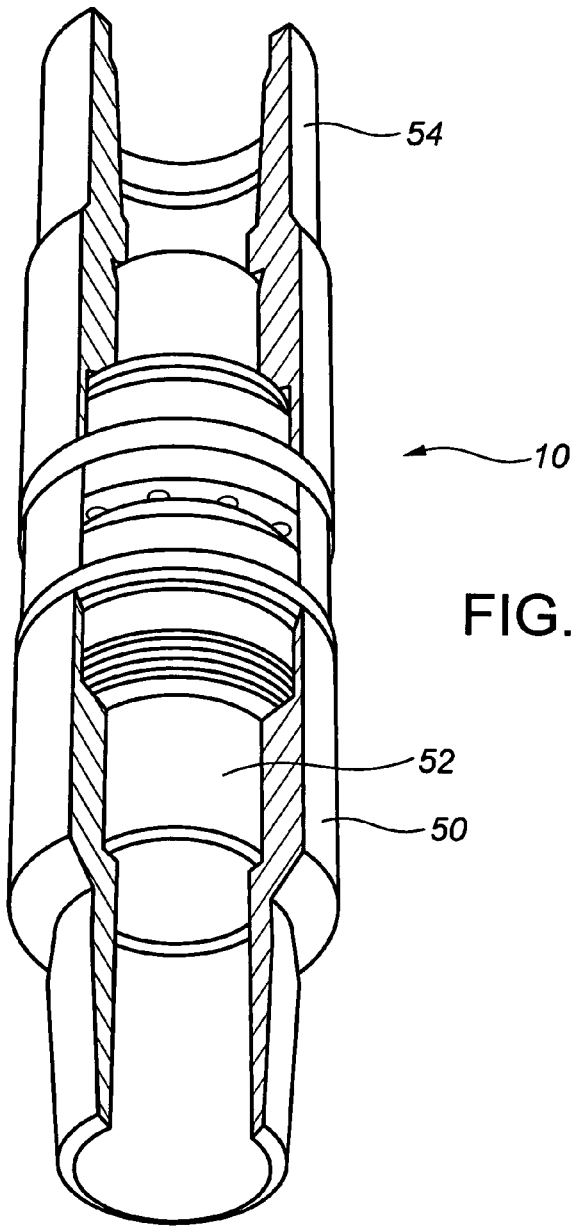
FIG. 6 is a perspective view of an embodiment of the current invention.
Figure 7:
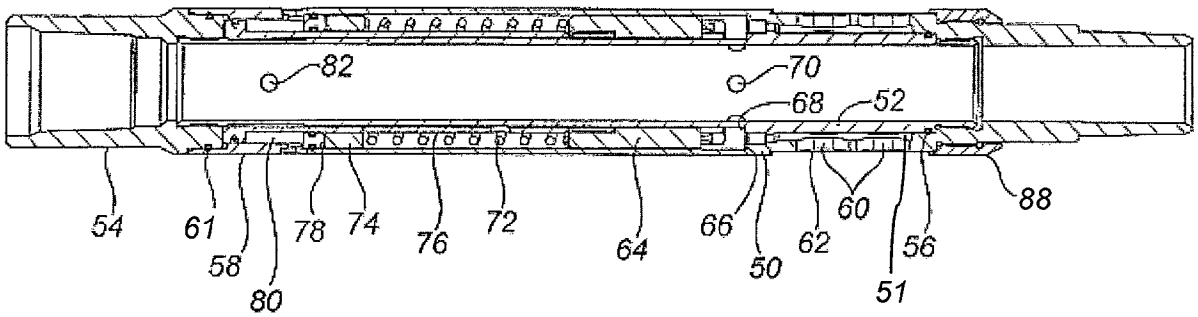
FIG. 7 is a schematic of the free flow control valve of the invention in an open position with the spring in a compressed state.

As shown in FIGS. 6 and 7, the valve (10) itself includes a housing (50), and a mandrel (52) concentrically disposed within the housing (50). The mandrel is attached to a top sub (54) which allows threaded connection to the remainder of the completion string, which may be run into the production tubing by conventional wireline techniques. At the lower end of the valve (10), the mandrel (52) engages the inner surface of the housing. An O-ring (56) provides a seal between the mandrel and the housing at the lower end.

The housing (50) engages a piston sub (58) which connects to the top sub (54), which connection is sealed with O-ring (61).

Figure 8:
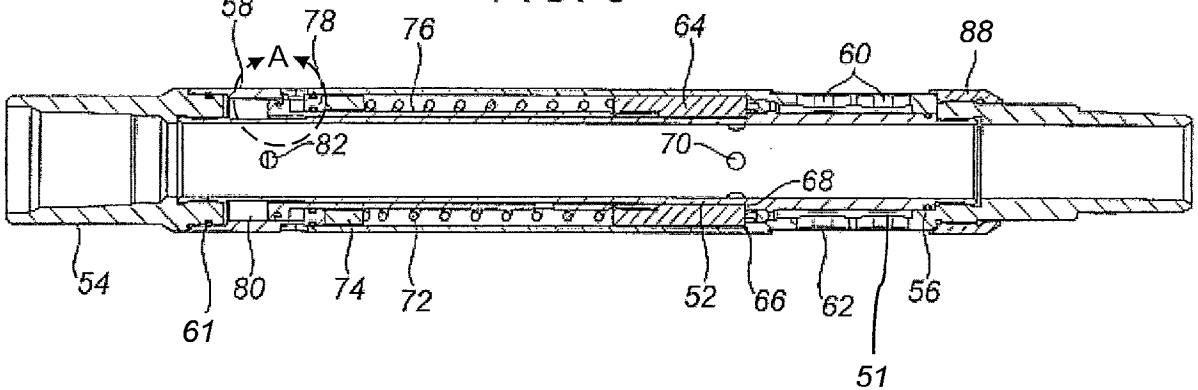
FIG. 8 is a schematic of the free flow control valve of the invention in a closed position with the spring in a relaxed state.
Figure 8A:
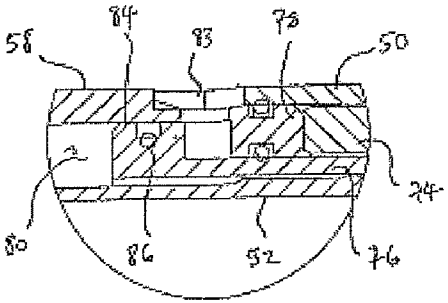
FIG. 8A shows a detail of the pressure equalization chamber.

The housing (50) defines a plurality of openings (60) which are preferably covered by a filter screen (62). The openings provide fluid communication from outside the housing (50) to a space (51) between the housing and the mandrel. Within the space (51) between the housing and the mandrel, a cylindrical member fits in close tolerance to the outside diameter of the mandrel and acts as a valve (64). In FIG. 8, the valve (64) is shown in its closed position, where the lower end of the valve member (64) is seated against a shoulder (66) formed on the inside of the housing, and against a shoulder (68) formed on the outside of the mandrel. In its open position, as shown in FIG. 7, the valve member (64) slides upwards and opens a fluid passageway between the two shoulders (66,68). The mandrel defines a number of openings (70) immediately above shoulder (68) which become exposed when the valve member (64) travels upwards and opens.

Therefore, when the valve member (64) is in its open position, a fluid passageway is created from the annular space, through housing openings (60), between shoulders (66, 68) and through mandrel openings (70), and into the production tubing through the interior of the valve (10).

When there is no pressure differential between the annulus and the internal bore of the mandrel, the valve member (64) is normally maintained in its lowered, closed position by coil spring (72) which is disposed in the same space between the housing and the mandrel. The upper end of the spring (72) bears on a spacer (74) while the lower end of the spring bears on the valve member (64). As is apparent, the compression of the spring (72) may be overcome by a pressure differential between the annular space, and the production tubing. Such fluid pressure urges the valve member (64) to its open position by overcoming the force of the spring (72). The force of the spring (72) on the valve (64), and therefore the pressure differential required to open the valve, may be varied by varying the strength of the spring or by increasing or decreasing the size of spacer (74).

In one embodiment, a valve extension piston (76) is attached to the upper end of the valve (64) and extends upwards between the spring (72) and the mandrel (52), and further extends past the spacer (74) and an isolation ring (78) which provides a seal with both the housing and the mandrel through the use of O-rings. The upper end of the valve extension piston (76) reciprocates within a pressure equalization chamber (80) which is in fluid communication with the production tubing by way of openings (82) in the mandrel. The upper end of the valve extension piston (76) does not cover the openings (82) to the equalization chamber (80). Therefore, the pressure equalization chamber (80) is always at the same pressure as that within the production tubing. At the same time, a lower portion of the pressure equalization chamber is open to the annular space through openings (83).

The upper end (84) of the valve extension piston slides along the inside of the pressure equalization chamber (80) and includes an O-ring seal (86). In one embodiment, it is preferred to have a highly polished surface inside the pressure equalization chamber (80) to limit the friction of the O-ring seal (86) and ensure the movement of the valve extension piston (76) is relatively unimpeded.

When fluid pressure in the annulus is higher than in the tubing, the pressure equalization chamber (80) utilizes the static pressure differential to help maintain the valve in a constant fall open state. This system dampens the effect of the gas flow pressure fluctuations induced by the expansion and contraction of the gas moving through the lower end of the valve (10).

An entry guide (88) encircles the housing at its lower end, and provides a chamfered sub to facilitate running the tools inside the tubing.

In operation, fluid such as a gas may be pumped downhole through the annulus, creating a pressure differential between the annulus and the production tubing. As a result, the valve (10) will open and allow fluid to flow into the production tubing. If an intermitter is installed, the introduced gas will assist in lifting the intermitter to the surface. When the pressure differential equalizes, the valve (10) will close.

The invention claimed is:

1. A downhole valve for insertion in a production tubing string and a casing string, wherein an annular space is defined between the tubing and the casing, said valve comprising:

(a) a cylindrical housing defining an opening;

(b) an internal mandrel disposed within the housing, defining a central bore and defining an opening;

(c) a valve disposed between the housing and the mandrel, wherein said valve is actuated by fluid pressure in the annular space which is greater than fluid pressure in the mandrel bore to move between a closed position which prevents fluid communication from the annular space to the mandrel central bore through the housing opening and the mandrel opening, and an open position which allows fluid communication from the annular space to the mandrel central bore through the housing opening and the mandrel opening; and (d) a spring for biasing the valve in the closed position, wherein the spring comprises a coil spring concentrically disposed within the housing, and around the mandrel.

2. The downhole valve of claim 1 wherein the valve comprises a sliding member having a sealing portion at its distal end, wherein said sealing portion covers the mandrel opening when the valve is in its closed position.

3. The downhole valve of claim 2 wherein the sliding member is a cylindrical member concentrically disposed within the housing and around the mandrel.

4. The downhole valve of claim 1 further comprising a pressure equalization chamber formed between the housing and the mandrel, a first portion of which is in fluid communication with the mandrel inner bore, and a second portion of which is in fluid communication with the annulus, and further comprising a valve extension piston which engages the upper end of the valve which comprises an upper end which reciprocates in the pressure equalization chamber between the first and second portions.

5. A method of recirculating fluid in a well comprising a production tubing string and a casing string, wherein an annular space is defined between the tubing and the casing, said method comprising the steps of:

(a) installing a valve as claimed in claim 1 into a completion string which forms part of the production tubing string, wherein said valve is disposed between two packoffs isolating a valve zone between them, said valve zone is in fluid communication with the annular space;

(b) installing a tubing packoff to isolate the annular space below the tubing packoff from the annular space above the tubing packoff; and (c) pumping fluid under pressure into the annular space such that the valve opens and the fluid passes into the production tubing string and returns to the surface.

6. The method of claim 5 wherein the recirculating fluid is a gas.

7. The method of claim 6 wherein the recirculating gas is used to drive an intermitter in the production tubing string.

8. The method of claim 6 wherein the recirculating gas is used to maintain a gas flow rate in the tubing.

* * * * *